US005135371A

United States Patent [19]

Arbogast et al.

[11] Patent Number: 5,135,371

[45] Date of Patent: Aug. 4, 1992

[54] INTERNAL GEAR PUMP WITH RADIAL OPENINGS

[75] Inventors: Franz Arbogast; Peter Peiz, both of Heidenheim, Fed. Rep. of Germany

[73] Assignee: J.M. Voith GmbH, Fed. Rep. of Germany

[21] Appl. No.: 667,673

[22] Filed: Mar. 11, 1991

[30] Foreign Application Priority Data

Mar. 9, 1990 [DE] Fed. Rep. of Germany ..... 4007462

[51] Int. Cl.[5] ..... F04C 2/10

[52] U.S. Cl. ..... 418/124; 418/168

[58] Field of Search ..... 418/124, 168, 169

[56] References Cited

U.S. PATENT DOCUMENTS

| | | | |
|---|---|---|---|
| 748,348 | 12/1903 | Cooley | 418/168 |
| 1,004,776 | 10/1911 | Green | 418/124 |
| 2,458,958 | 1/1949 | Pigott et al. | 418/168 |
| 2,790,394 | 4/1957 | Mori | 418/168 |
| 4,028,023 | 6/1977 | Labus | 418/168 |
| 4,934,913 | 6/1990 | Pippes | 418/169 |

*Primary Examiner*—John J. Vrablik

*Attorney, Agent, or Firm*—Ostrolenk, Faber, Gerb & Soffen

[57] ABSTRACT

A crescent-less internal gear pump. The internally geared wheel has a plurality of radial openings from its peripheral surface into the tooth gaps at the tooth base. The axial width of the pinion and/or the internally geared wheel is at least as great as the diameter of the rolling circle of the pinion. The filling of the inside of the pump through radial openings makes it possible to make the internally geared wheel as axially wide as the suction connection or as that part of the housing which receives the active gear parts participating in the formation of the delivery stream. It is possible to develop the axial width of the toothing considerably larger than the diameter of the rolling circle of the pinion. Complete filling of the tooth gaps with pressure fluid is assured without the occurrence of flow velocities at which the formation of noise or other disadvantages is to be expected. The pump can also be provided with two internally geared wheels arranged alongside each other.

17 Claims, 4 Drawing Sheets

INTERNAL GEAR PUMP WITH RADIAL OPENINGS

BACKGROUND OF THE INVENTION

The present invention relates to a crescent-less internal gear pump for producing high pressures, and having radial openings through the internally geared wheel into the tooth gaps between teeth of that wheel. A pump of this type is known from U.S. Pat. No. 2,915,982.

Such gear pumps have an internally toothed, internally geared wheel which surrounds an externally toothed pinion having a smaller number of teeth. The teeth in those gears are in driving engagement. As a general rule, the toothing of such pumps is relatively narrow in the axial direction of the pump, as compared to the diameter of the pinion or of the internally geared wheel. The volumetric flow to be conveyed by the pump is determined by the radial height of the teeth and by the width of the toothing in the axial direction of the pump. It is important that each cell which is formed by each tooth gap in the internally geared wheel and by the tooth of the pinion projecting into that tooth gap is filled as completely as possible with pressure fluid in the suction or intake region of the pump.

The known pump is provided with radial openings which extend from the outer circumference, or surface or periphery of the internally geared wheel into the tooth gap and through which pressure fluid can flow into the tooth gap. The internally geared wheel is, in this case, tightly surrounded by a sleeve which does not rotate with the internally geared wheel and which has a narrow slot for distributing the pressure fluid from the suction intake of the pump to the radial openings around the internally geared wheel. These radial openings, however, are of only slight axial length, along the direction of the axis of rotation of the pump, which is also referred to as the axial width of the internally geared wheel. Complete filling of the cells, therefore, appears possible only if the pump is operated at a particularly low speed of rotation. Otherwise, the pressure fluid must pass through the radial openings with a velocity of flow which is greater than the values which are favorable from a hydraulic fluidic standpoint.

If the velocity of flow of pressure fluid through the radial openings is in excess of an optimal value, which lies in the region of one meter per second, then the pressure in the flowing fluid assumes such low values that the air dissolved in the fluid emerges again. This leads to a strong formation of noise. Furthermore, this results in poor volumetric efficiency, leading the operator to select a larger pump when a given delivery volume is desired.

In the known pump, the internally geared wheel and the pinion are limited laterally by sealing plates which are pressed axially against the end sides of the pinion and of the internally geared wheel. Above a given pressure, these sealing plates move away axially from the gears so that the pump is not suitable for very high pressures, despite axial force application on the plates by springs or pistons.

It is true that it has been possible with the known pump to obtain a definite reduction in the outside dimensions, as compared with the internal gear pump known from U.S. Pat. No. 4,968,233. That known pump has cell space between the pinion and the internally geared wheel which is filled merely from both sides in the axial direction. The pressure fluid can flow in radially, laterally outside of the internally geared wheel. Therefore, the pinion and the internally geared wheel can have also only a small length in the axial direction. The toothed active rotating parts of the pump accordingly take up only a small portion of the structural length of the pump, while the remaining structural length is taken up by the housing with the lateral inflow of the pressure fluid. Therefore, even for a pump of low delivery volume, a large axial structural length must be tolerated. As compared with this, the pump in U.S. Pat. No. 2,915,982 is a considerable improvement. The construction of the internally geared wheel and of the suction port, however, still permits an expectation of conditions of flow which involve excessively high velocities of flow within the pump, and high pressures still cannot be obtained.

SUMMARY OF THE INVENTION

The object of the present invention is to so improve a pump of the above described type that its outside dimensions are still further reduced and so that the suction region of the pump is not a determinative value for the structural volume of the pump, and so that optimal values for the velocity of flow can be maintained.

This object is achieved by the present invention which relates to a crescent-less internal gear pump in which the internally geared wheel has a plurality of radial openings from the outer wall surface into the tooth gaps at the bases and in which the axial width of the pinion and/or internally geared wheel is at least as great as the diameter of the rolling circle of the pinion. The filling of the inside of the pump through radial openings in the internally geared wheel makes it possible to make the internally geared wheel as wide axially as either the suction connection or that part of the housing which receives the active gear parts which participate in forming the delivery stream. The invention minimizes the structural volume of the pump, and the suction region no longer provides the determining value for the structural size. It is possible to develop the axial width of the gear toothing to be considerably larger than the diameter of the rolling circle of the pinion, because complete filling of the tooth gaps with pressure fluid is always assured without the occurrence of flow velocities at which the formation of noise or other disadvantages are to be expected. For this purpose, the pump can also be provided with two internally geared wheels arranged alongside of each other.

The internally geared wheel and the pinion are for this purpose limited in an axially sealing fashion at their end surfaces directly by the axially adjacent housing parts and those gears are guided by those housing parts. Thus, the pump is suitable for the production of very high pressures. Because the entire cross-sectional area of all openings extending through the internally geared wheel represents at least 20% of the outer wall surface of the internally geared wheel and the radial openings extend over 60 to 70% of the axial width of the gear toothing, it is possible to satisfactorily fill these cells formed by the toothing in the suction region of the pump with pressure fluid, and the axial width of the toothing is greater than the diameter of the rolling circle of the pinion. The main or common housing part which receives the active gears which participate in the formation of the delivery stream, namely the internally geared wheel and the pinion, should have at least 40% of the total axial length of the pump or corresponding housing parts. The gear wheels which participate in the delivery of the pressure fluid thus take up a considerably higher proportion of the total structural space of the pump than in prior pumps so that, while a given maximum value for the velocity of flow is maintained, a pump having a larger delivery capacity is created.

The radial openings through the internally geared wheel present no obstacles to flow which might oppose the filling of the cells defined by the cooperating meshing teeth, so that the internally geared wheel with pinion can be axially widened considerably as compared with known gear pump constructions. The axial width of the toothing thus no longer represents a determining value for the pump. The velocity of flow within the pump increases proportionally to the volume delivered and is, therefore, proportional to the product of the speed of rotation, the outside diameter and the width of the internally geared wheel. The velocity of flow, however, is also inversely proportional to the cross-sectional area of all radial openings in the internally geared wheel. This cross-sectional area is, according to the invention, to be a given percentage of the outer wall surface of the internally geared wheel, corresponding to the outer diameter and the width of the pinion. It can be seen that the velocity of flow is determined essentially only by the speed of rotation and by the size of the cross-sectional area of all openings through the internally geared wheel and, therefore, by their shape, size and number. The pump flange and pump covers adjoin the housing central part at its axial end sides. The pump housing central part, which receives the rotating parts can, as part of a building block system, remain identical for pumps of different axial widths. In this connection, the combination of features in accordance with the invention assures improved mechanical and volumetric efficiency of the pump.

The internally geared wheel and the pinion have involute toothing. The known pumps of U.S. Pat. Nos. 2,915,982 and 4,968,233 have a round toothing, known also under the name trochoid toothing. This has the advantage that all teeth of the pinion are in constant engagement with the flanks of the trochoid toothing of the internally geared wheel. As a result, individual cells of variable volume are formed between each pair of gear teeth which are in engagement. These cells must in each case be pressure tight in themselves with respect to the adjacent cell. In this connection, there is continuous sliding between the tooth head of the pinion and the adjacent tooth flanks of the internally geared wheel. Involute toothing, which up to now has not been customarily used in pumps of this type, can be manufactured more easily and with greater precision with traditional tools. Furthermore, such toothing has the advantage that the teeth of the pinion and of the internally geared wheel come out of engagement outside the direct regions of engagement and, after approximately one revolution, they again come into engagement along an engagement path. In this connection, the engagement takes place without any rotary acceleration, which favors quiet operation and reduces wear. It is, furthermore, essential for involute toothing that only one flank of the teeth of one of the internally geared wheel or the pinion rests against the mating or opposed flank of the other gear so that there is meshing toothing with play.

The radial openings through the internally geared wheel can extend up into the region of the unloaded flanks on the internally geared wheel. Those are the tooth flanks not drivingly engaged by the pinion. These radial openings can be developed either as a row of bored holes or as elongate openings lying alongside of each other and along a tooth gap between two teeth of the internally geared wheel. Along the same tooth gap in the toothing, the radial openings are preferably arranged symmetrically to each other and are equally spaced axially apart.

As already mentioned, the invention concerns a pump with play. With respect to that, it is known that the volumetric efficiency also depends strongly on the clearance conditions in the region of the tooth head contact between the teeth of the internally geared wheel and of the pinion. For improving the seal between the tooth heads of the pinion and the internally geared wheel, there is a sealing element, which is preferably placed on the tooth heads of the pinion, but which may be placed on the tooth heads of the internally geared wheel or on the tooth heads of both gears.

It is further advantageous if the sealing elements are connected on their rear sides, which is the side that faces away from the tooth heads, via connecting channels with the tooth flank facing the pressure region that is, the tooth flank engaged by a tooth of the other gear. This causes the pressure which builds up in front of the tooth flank to be propagated to the rear of the sealing elements and this, in turn, presses the sealing elements in sealing fashion against the opposite tooth heads of the corresponding other gear.

For special cases, there are two pump housing parts that are located on the opposite axial sides of the gears and that also hold the mountings for the pinion shaft. If those pump housing side parts permit this with regard to construction space, those housing side parts can be provided on both sides of the internal geared wheel with additional suction pockets in order to improve the suction behavior. In this way, a certain amount of pressure fluid can also emerge from the sides between the pinion and the internal geared wheel.

A widening of the internally geared wheel in the axial direction in order to increase the volume of delivery of the pump encounters limits from the standpoint of manufacture with respect to the precision and the quality of the surfaces of the toothing. Therefore, the pump may be provided with two internally geared wheels which are coaxial, alongside each other and are jointly in engagement with a single piece pinion. In this case, the two internally geared wheels can be substantially identical, with each of them being developed with regard to manufacture at an optimal width. In the pump, however, they act like a single internally geared wheel. In addition, the individual internally geared wheels may be connected to be fixed for rotation with each other. The pinion itself generally is not subject, with respect to its axial width of toothing, to such limitations on manufacture with regard to the precision of the toothing. By means of the above described axial widening of the pump, it is possible to increase its delivery flow without increasing its outside diameter. In this connection, it is nevertheless possible to keep the velocity of flow within the pump at a feasible value, for instance one meter per second. A gear pump having two or even more internally geared wheels can be so designed that the axial width of the toothing is at least 60% of the total axial length of the pump.

Other objects and features of the invention are described below with reference to the drawings which show one embodiment.

DESCRIPTION OF THE PREFERRED EMBODIMENTS

Figure 1:
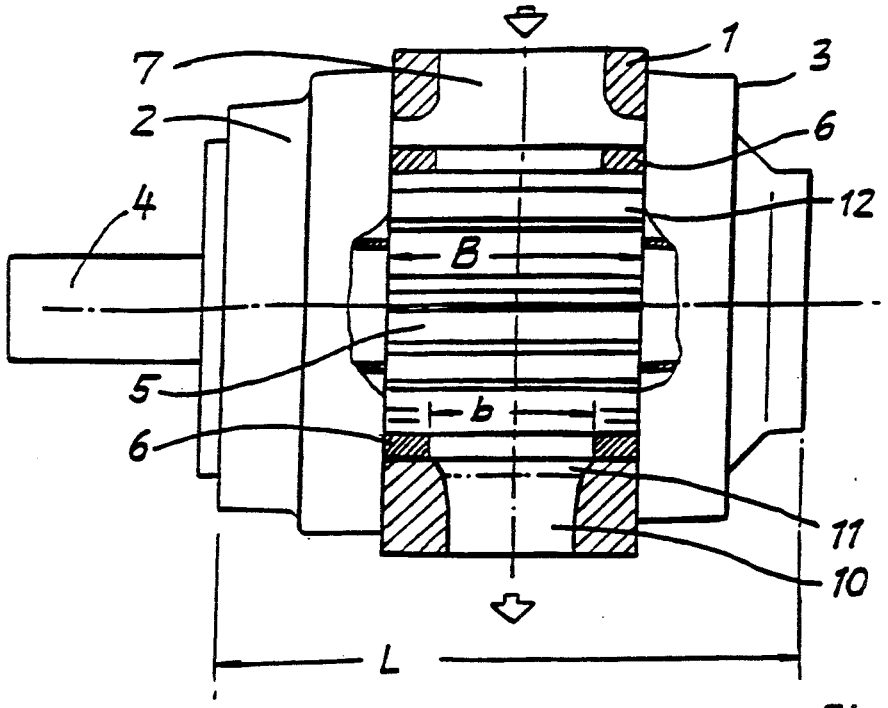
FIG. 1 is a partial longitudinal section through a pump of the invention.
Figure 2:
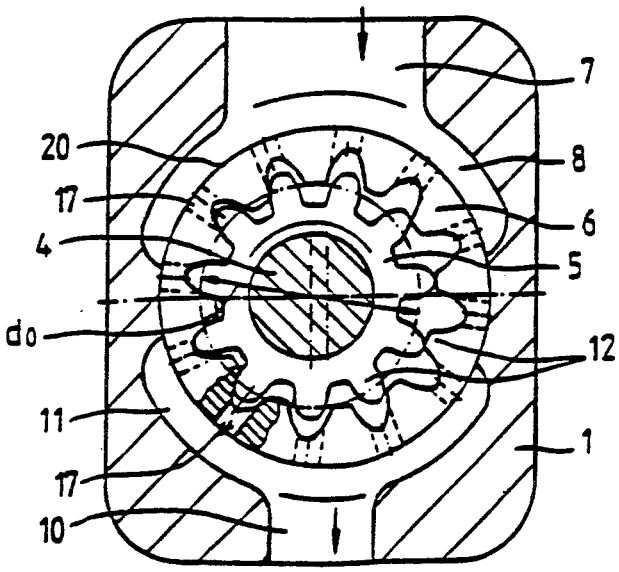
FIG. 2 is a cross section through the pump in the region of the two wheels.

FIGS. 1 and 2 show, in longitudinal section and cross section, a crescent-less tooth head sealing gear pump with clearance which seals in each case with one cooperating set of tooth flanks, and shown in the region of its housing center part 1. Adjoining both axial sides of the housing center part, there are other housing side parts 2 and 3. The entire pump, together with the housing parts 1, 2, 3, has a total axial length L.

An externally toothed pinion 5 which is fastened on a drive shaft 4 is in driving engagement with an internally toothed, hollow gear wheel 6. Both the toothing 12 of the pinion 5 and of the internally geared wheel 6 are involute and have the same axial width B. The pinion has a rolling circle diameter dO. The axial width B of the toothing of the pinion is greater than the diameter dO of the rolling circle.

The pinion 5 and the internally geared wheel 6 are not mounted coaxially with respect to each other but rather are mounted eccentrically. Furthermore, the pinion 5 has one tooth fewer than the internally geared wheel 6. In each case, the outer side of a tooth head 13 on the pinion 5 comes into contact with the inner side of a tooth head 14 on the internally geared wheel 6. There is a suction connection 7 in the zone at which, upon rotation in the direction indicated by the arrow, the teeth on the pinion and the internally geared wheel respectively come out of engagement.

Axially adjoining the suction connection 7 in the central part 1 of the housing, in which the internally geared wheel and the pinion are mounted, there is in each of the axially neighboring housing parts 2 and 3 a suction pocket 8, which extends over a part of the outer surface 20 of the internally geared wheel 6.

A pressure connection 10 starts from a pressure pocket 11 and extends over a circumferential region on the internally geared wheel, on the diametrically opposite side of the pump from the suction connection 7. The flow of pressure fluid to the inside of the pump, i.e., to the tooth gaps between the teeth of the pinion 5 and the teeth of the internally geared wheel 6, which gaps effect the delivery of the pressure fluid, is via radial openings 17 through the internally geared wheel 6. The openings 17 extend from the outer or peripheral surface 20 of the wheel 6 and debouch in the tooth base of the internally geared wheel.

Figure 3:
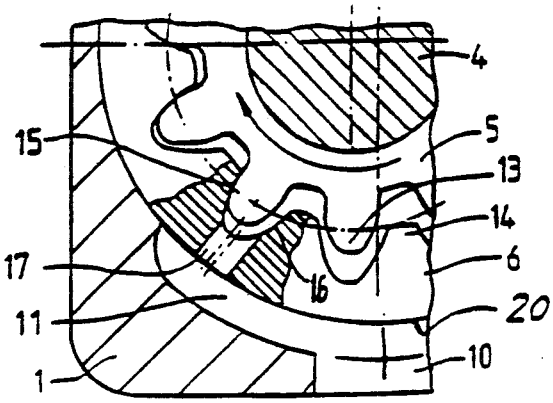
FIG. 3 is a detailed view in the region of the toothing.

FIG. 3 shows a detail of the toothing 12 between the pinion 5 and the internally geared wheel 6. In this cross-section through the internally geared wheel 6, one of the openings 17 can be noted. It debouches in such a manner in the tooth base of a tooth gap in the internally geared wheel that the tooth base is broken through over its entire width in the circumferential direction and, furthermore, it also cuts the rear or trailing tooth flank 16, as seen in direction of rotation. The front or leading or operative tooth flank 15, which is driven by the pinion 5, is the loaded flank which produces a seal with respect to the inner space and is not affected by the opening 17. The opening 17 is accordingly arranged eccentrically with respect to the axis of the tooth gap of the internal geared wheel. This makes it possible to make the passage cross section of the opening 17 larger.

Figure 4:
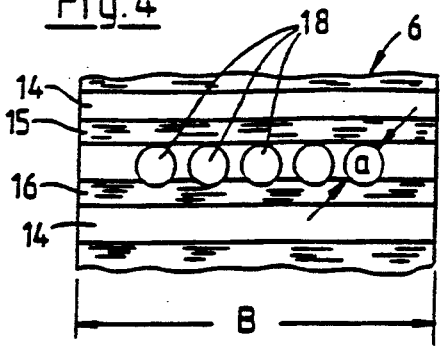
FIG. 4 shows openings in the form of bored holes.

FIG. 4 shows a view of a tooth gap in the internally geared wheel 6. There are a plurality of the radial openings which are developed as circular bore holes 18 each of a diameter a.

Figure 5:
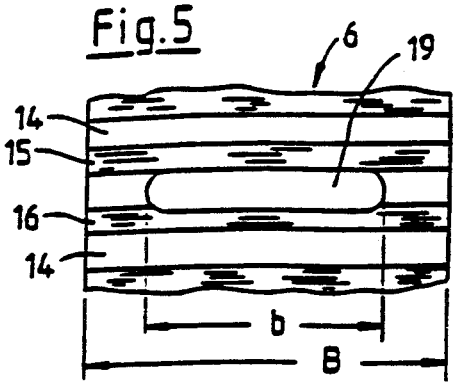
FIG. 5 shows openings in the form of slots.

FIG. 5 shows a similar view in which the radial opening is developed as an axially elongate opening 19. The passage cross sections are in each case selected so that all bore holes having the diameter a in accordance with FIG. 4 or the elongate opening 19 in accordance with FIG. 5 with the axial width b amount to between 60 and 70% of the axial width B of the internally geared wheel. The total cross sectional area of all bore holes 18 and/or openings 19 should amount to at least 20% of the outer surface 20 of the internally geared wheel.

Figure 6:
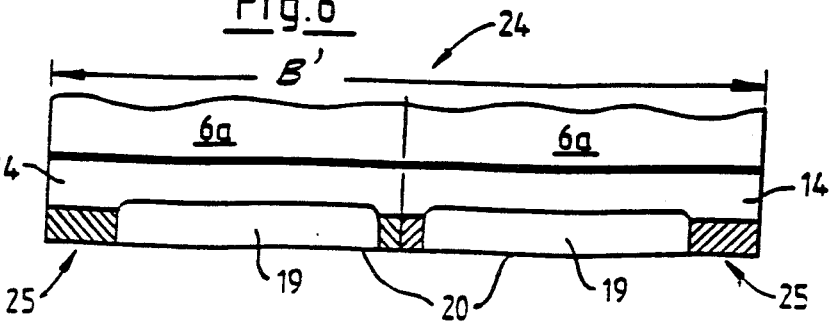
FIG. 6 shows the development of a double internally geared wheel.

FIG. 6 shows a double internally geared wheel 24 comprised of two internally geared wheels 6*a* sitting alongside each other and coaxial. The double wheel is in engagement (not shown) with a pinion of the same axial length as the two internally geared wheels, but the pinion is of one part construction. The radial openings 19 on the outer surface 22 are developed as elongated opening 19 and are not arranged axially centrally within the individual internal geared wheel 6*a* but in each case are shifted toward the end side facing the other internally geared wheel 6*a*. This produces widened sealing surfaces 25 on the axial end sides facing the housing end parts 2, 3 on both internally geared wheel parts 6*a*. A similar seal between the two parts 6*a* of the double internally geared wheel 24 is not necessary. Therefore, thin webs are sufficient there as limitations for the openings 19.

Figure 7:
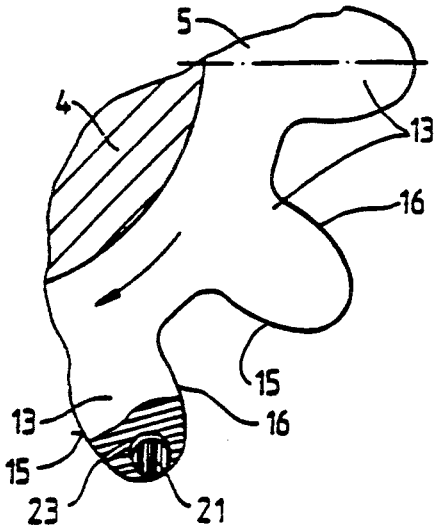
FIG. 7 shows the development of a first embodiment of sealing ledges on the pinion.
Figure 8:
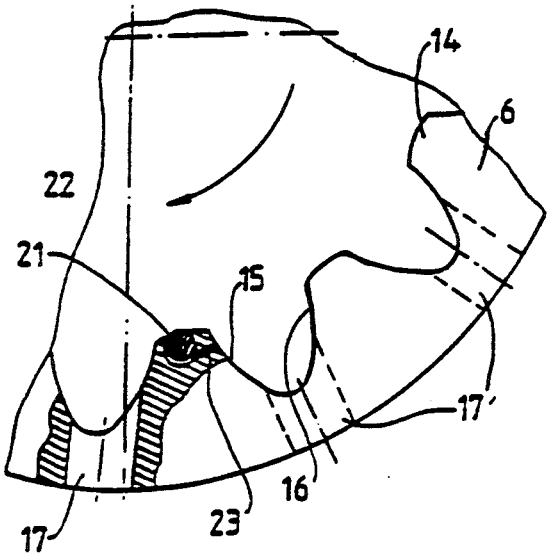
FIG. 8 shows the development of a first embodiment of sealing ledges on the internally geared wheel.

FIGS. 7 and 8 are detailed views of the tooth heads 13 and 14 on the pinion 5 and the internal geared wheel 6, respectively. In FIG. 7, one tooth has a sealing ledge 21 which is developed as a circular profiled section which is inserted into a groove which extends axially along the tooth head 13. The rear or radially inward side of the sealing ledge 21 is in communication via a bore hole 23 with that flank 15 which faces the pressure region upon engagement with the internally geared wheel. In this way, pressure is built upon the rear of the sealing ledge 21, pressing the sealing ledge 21 on the pinion against the opposite tooth head of the internally geared wheel.

An alternative embodiment in which the sealing element is developed with a T-section 22 is shown in FIG.

10. It also is inserted in a corresponding longitudinal groove extending axially along the tooth head and is in communication via a bore hole 26 with the tooth flank 15 facing the pressure region. The sealing elements 21 and 22 are made of plastic with wear properties for facilitating a run-in phase of the pump.

Figure 11:
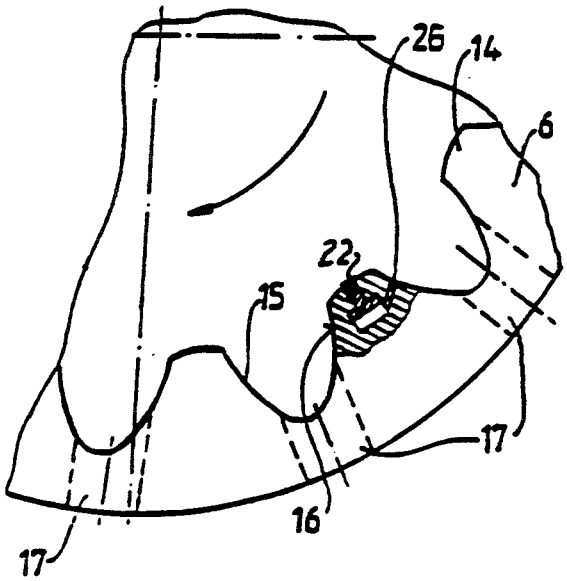
FIG. 11 shows the development of an alternate embodiment of sealing ledges on the internally geared wheel.

FIGS. 8 and 11 show similar arrangements of either a circular sealing ledge 21 or a T-section 22 on the tooth heads 14 of the internally geared wheel 6. FIG. 8 further shows openings 17 for the filling of the inside of the pump, the width B of the internally geared wheel and pinion being at least as great as the diameter dO of the rolling circle of the pinion 5 (shown in FIGS. 1 and 2).

Figure 9:
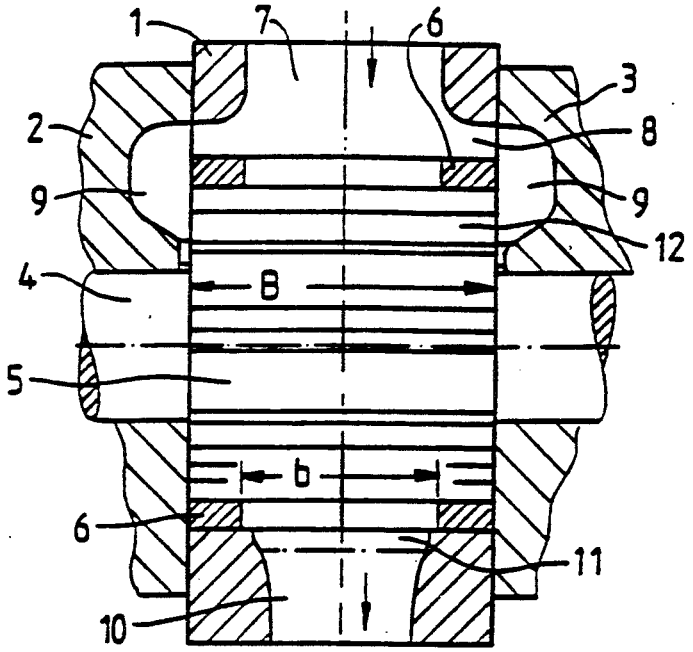
FIG. 9 is a partial longitudinal section through the pump with additional suction pockets in the axial end parts of the housing.
Figure 10:
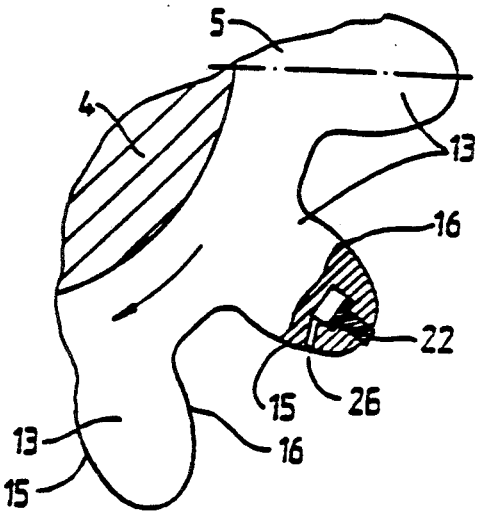
FIG. 10 shows the development of an alternative embodiment of sealing ledges on the pinion.

FIG. 9 shows a pump similar to that of FIG. 1. The suction region 7 is in this case widened in the axial direction into both of the housing parts 2 and 3, and in those housing parts 2 and 3, the suction region is developed as suction pockets 9. This makes it possible to obtain improved filling even in the axially outermost region of the toothing. This is advantageous because the mounting of the pinion shaft 4 in the housing parts 2 and 3 permits the development of such suction pockets 9 without requiring an increased total length L.

By these features in accordance with the invention, there is created a pump which, for given outside dimensions, has a higher delivery volume than known pumps, or for a predetermined delivery volume can have smaller outside dimensions, without impermissibly high velocities of flow resulting in the pump.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. An internal gear pump comprising:

an internally geared wheel having an external periphery, a first plurality of first involute gear teeth projecting radially inwardly and tooth gaps being defined adjacent first teeth; the internally geared wheel defining and surrounding an open space; the first teeth having a width in the axial direction;

a pinion disposed within the open space, the pinion having a second plurality of outwardly projecting second involute gear teeth meshing with at least some of the inwardly projecting first teeth;

the width of the second teeth of the pinion in the axial direction is at least as great as the diameter of the rolling circle of the pinion;

a common housing part around the external periphery of the internally geared wheel, and the axial length of the common housing part corresponding to the axial width of the first teeth, the internally geared wheel and the pinion both being mounted for rotation in the common housing part;

a suction connection in the common housing part at one side of the external periphery of the internally geared wheel; a pressure connection in the common housing part at another side of the external periphery of the internally geared wheel;

the internally geared wheel having radial openings extending from the periphery thereof into the tooth gaps in the internally geared wheel, the radial openings being developed as adjacent bore holes which are arrayed in respective rows along the axial width of the internally geared wheel at each of the tooth gaps; the entire cross-sectional area of all of the radial openings extending through the internally geared wheel amounts to at least 20% of the surface area of the periphery of the internally geared wheel as determined both by the width in the axial direction and the outside diameter of the internally geared wheel; the total width in the axial direction of the radial openings through the internally geared wheel along a single tooth gap thereof amounts to between 60% and 70% of the width in the axial direction of the teeth of the internally geared wheel.

2. The pump of claim 1, further comprising laterally disposed housing parts at both axially lateral sides of the internally geared wheel and the pinion, and the laterally disposed housing parts both limiting the internally geared wheel and the pinion in an axially sealing manner and guiding them laterally;

the axial width of the common housing part amounts to at least 40% of the total axial length of the gear pump.

3. The pump of claim 2, wherein the internally geared wheel has one more tooth than the pinion.

4. The pump of claim 2, wherein the radial opening bore holes are distributed symmetrically and with equal spacing from each other over the axial width along each respective tooth gap.

5. The internally geared pump of claim 2, further comprising additional suction pockets defined in the laterally disposed housing parts and located in the circumferential region of the suction connection and located axially alongside the internally geared wheel.

6. The pump of claim 2, wherein the first teeth of the internally geared wheel have respective loaded flanks, which are the flanks engaged by flanks of the second teeth of the pinion, and have unloaded flanks, which are not engaged by the flanks of the second teeth of the pinion during driving rotation of the pinion, and the first and second teeth are respectively of such widths in the circumferential direction that there is a circumferential space, in each tooth gap, between the unloaded flank of the internally geared wheel first tooth and the adjacent flank of the adjacent second tooth of the pinion when the second tooth of the pinion is in a tooth gap between two first teeth.

7. The pump of claim 6, wherein the radial openings through the internally geared wheel extend into the region of the respective tooth gaps that communicates with the unloaded flanks of the first teeth.

8. The pump of claim 2, wherein each of the first and second teeth of the pinion and of the internally geared wheel includes a tooth head which projects furthest into the respective tooth gap between two of the teeth of the other one of the internally geared wheel and the pinion;

a respective sealing element is supported in each tooth head of at least one of the pinion and the internally geared wheel, and the sealing element being slidable on the opposed tooth of the other of the internally geared wheel and pinion.

9. The pump of claim 8, wherein the sealing elements are disposed on the tooth heads of the pinion.

10. The pump of claim 8, wherein the sealing elements are comprised of plastic material and are profiled.

11. The pump of claim 10, wherein the sealing elements are comprised of a plastic with wear properties for facilitating a run-in phase of the pump.

12. The pump of claim 8, wherein each sealing element is developed as a round profiled section extending axially along the respective tooth head.

13. The pump of claim 8, wherein the sealing element is developed as a sealing strip of T-section extending axially along the respective tooth head.

14. The pump of claim 8, wherein each tooth having a sealing element also has at least one connecting channel that communicates with the sealing element on that side of the sealing element that faces away from the tooth head and communicates with that tooth flank on the tooth with the sealing element that engages the tooth flank on the other of the internally geared wheel and the pinion.

15. The internally geared pump of claim 2, wherein the internally geared wheel is comprised of two substantially identical internally geared wheels on a common axis and the two wheel are in engagement with a single one of the pinions.

16. The internally geared pump of claim 15, wherein the two internally geared wheels are connected and fixed for rotation with each other and are axially alongside each other.

17. The internally geared pump of claim 16, wherein the width of the common housing part corresponds to the combined axial width of the toothing of the two internally geared wheels and that amounts to 60% of the total axial length of the pump.

* * * * *